US008292335B1

(12) United States Patent
Hemingway

(10) Patent No.: US 8,292,335 B1
(45) Date of Patent: Oct. 23, 2012

(54) BALLOON-TYING DEVICE

(76) Inventor: Frank S. Hemingway, Laurel, MD (US)

( * ) Notice: Subject to any disclaimer, the term of this patent is extended or adjusted under 35 U.S.C. 154(b) by 83 days.

(21) Appl. No.: 12/803,865

(22) Filed: Jul. 8, 2010

Related U.S. Application Data

(60) Provisional application No. 61/270,628, filed on Jul. 10, 2009.

(51) Int. Cl.
*D03J 3/00* (2006.01)

(52) U.S. Cl. ..... 289/17

(58) Field of Classification Search ..... 289/2, 17, 289/18.1
See application file for complete search history.

(56) References Cited

U.S. PATENT DOCUMENTS

| | | | | |
|---|---|---|---|---|
| 2,005,129 | A * | 6/1935 | Chase | 57/22 |
| 2,773,713 | A * | 12/1956 | Smalley | 289/17 |
| 3,688,357 | A * | 9/1972 | Nielsen et al. | 289/17 |
| 5,039,142 | A | 8/1991 | Muma | |
| 5,314,217 | A | 5/1994 | Place | |
| 5,568,950 | A | 10/1996 | Herren | |
| 5,611,578 | A | 3/1997 | Angelico, Sr. et al. | |
| 5,647,615 | A | 7/1997 | Messier | |
| 5,882,051 | A | 3/1999 | Dreger et al. | |
| 6,082,785 | A | 7/2000 | Morgan et al. | |
| 6,227,580 | B1 | 5/2001 | Sundby | |
| 6,325,426 | B1 | 12/2001 | Boesl | |
| 6,540,267 | B1 * | 4/2003 | Rohbock et al. | 289/1.2 |
| 6,902,212 | B1 | 6/2005 | Mize | |
| 7,488,011 | B2 * | 2/2009 | Seo et al. | 289/2 |
| 2003/0160453 | A1 | 8/2003 | Jolly | |
| 2004/0198146 | A1 | 10/2004 | Murray et al. | |
| 2010/0072750 | A1 | 3/2010 | Nance | |

FOREIGN PATENT DOCUMENTS

| | | | |
|---|---|---|---|
| GB | 2250032 | A * | 5/1992 |

* cited by examiner

*Primary Examiner* — Shaun R Hurley
(74) *Attorney, Agent, or Firm* — Emery L. Tracy

(57) ABSTRACT

A balloon-tying device for assisting in tying a balloon is provided, the balloon having a filling end. The balloon-tying device comprises a base having a top surface and a bottom surface substantially opposite the top surface. A pair of spaced tying prongs is provided with each having a base end and a top end and the base ends of the tying prongs secured to the top surface of the base. A ridge extends from the top end of each of the tying prongs wherein the filling end of the balloon is wrappable around the tying prongs and fed between the tying prongs and wherein the ridges maintain the filling end of the balloon from inadvertently slipping from the tying prongs during the tying process.

18 Claims, 7 Drawing Sheets

BALLOON-TYING DEVICE

The present application claims the benefit of priority of pending provisional patent application Ser. No. 61/270,628, filed on Jul. 10, 2009, entitled "Balloon-Tying Device".

BACKGROUND OF THE INVENTION

1. Field of the Invention

This invention relates generally to a balloon-tying device and, more particularly, the invention relates to a balloon-tying device for facilitating the tying of air-, water-, and helium-filled balloons.

2. Description of the Prior Art

There is a prevalence of air-, helium-, and water-filled balloons in our society. In fact, balloons are used for everything from birthday parties to weddings to yard sales to water-balloon fights, and every one of those balloons must be laboriously tied by hand, which can be a frustrating and time-consuming process. Clearly, there is a need for an invention that makes the process quicker and easier.

SUMMARY

The present invention is a balloon-tying device for assisting in tying a balloon. The balloon has a filling end. The balloon-tying device comprises a base having a top surface and a bottom surface substantially opposite the top surface. A pair of spaced tying prongs is provided with each having a base end and a top end and the base ends of the tying prongs secured to the top surface of the base. A ridge extends from the top end of each of the tying prongs wherein the filling end of the balloon is wrappable around the tying prongs and fed between the tying prongs and wherein the ridges maintain the filling end of the balloon from inadvertently slipping from the tying prongs during the tying process.

The present invention further includes a method for assisting in tying a balloon. The balloon has a filling end. The method comprises providing a base having a top surface and a bottom surface substantially opposite the top surface, securing a pair of spaced tying prongs to the top surface of the base, extending a ridge from an unsecured end of each of the tying prongs, wrapping the filling end of the balloon around the tying prongs, feeding the filling end between the tying prongs, and maintaining the filling end of the balloon from inadvertently slipping from the tying prongs during the tying process.

DETAILED DESCRIPTION OF THE PREFERRED EMBODIMENTS

Figure 1:
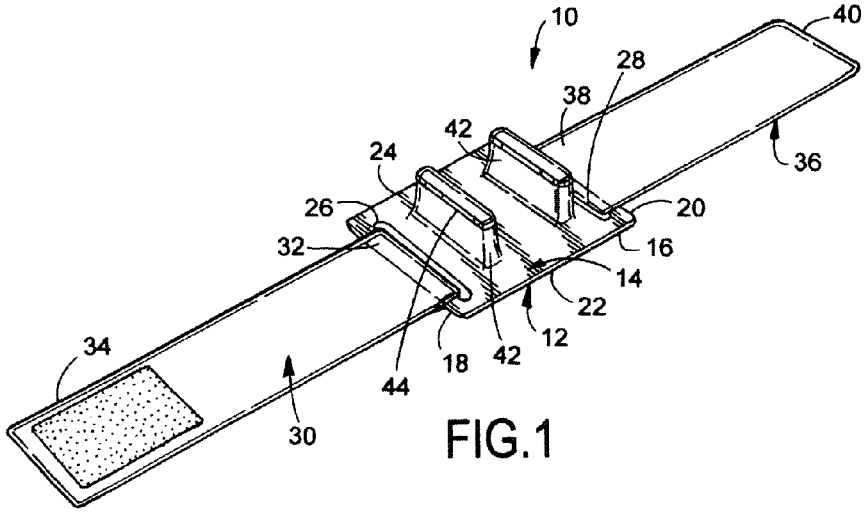
FIG. 1 is a perspective view illustrating a balloon-tying device, constructed in accordance with the present invention.
Figure 3:
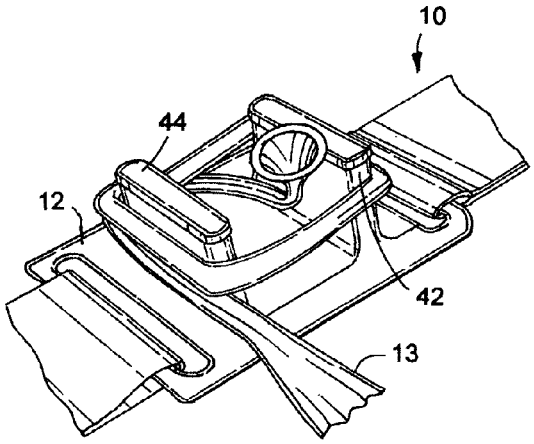
FIG. 3 is still another perspective view illustrating the balloon-tying device of FIG. 1, constructed in accordance with the present invention, with the balloon in the process of being tied.
Figure 2:
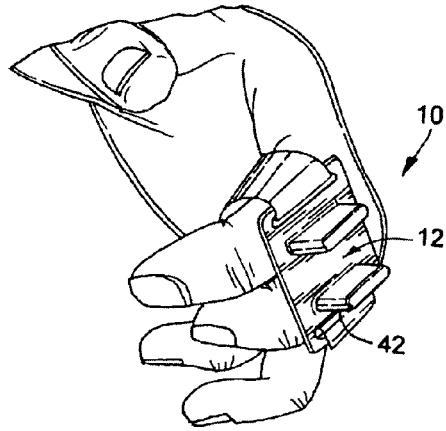
FIG. 2 is another perspective view illustrating the balloon-tying device of FIG. 1, constructed in accordance with the present invention, with the device mounted to a user's hand.
Figure 4:
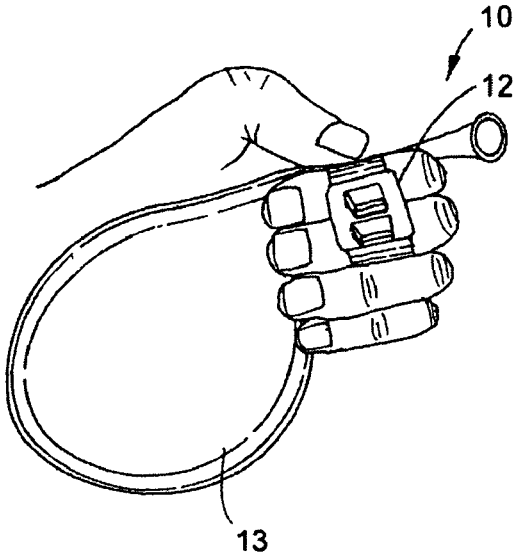
FIG. 4 is yet another perspective view illustrating the balloon-tying device of FIG. 1, constructed in accordance with the present invention, with the device mounted to a user's hand, pinched closed with thumb, and the balloon in the process of being tied.
Figure 9:
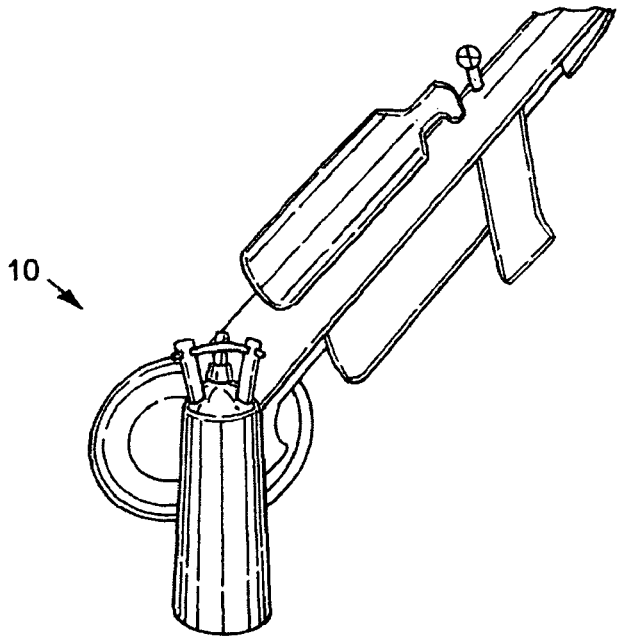
FIG. 9 is a perspective view illustrating still another embodiment of the balloon-tying device, constructed in accordance with the present invention.
Figure 5:
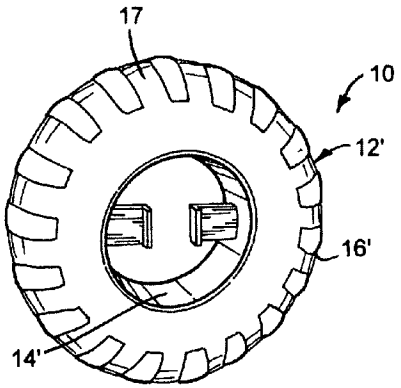
FIG. 5 is a perspective view illustrating another embodiment of the balloon-tying device, constructed in accordance with the present invention.
Figure 6:
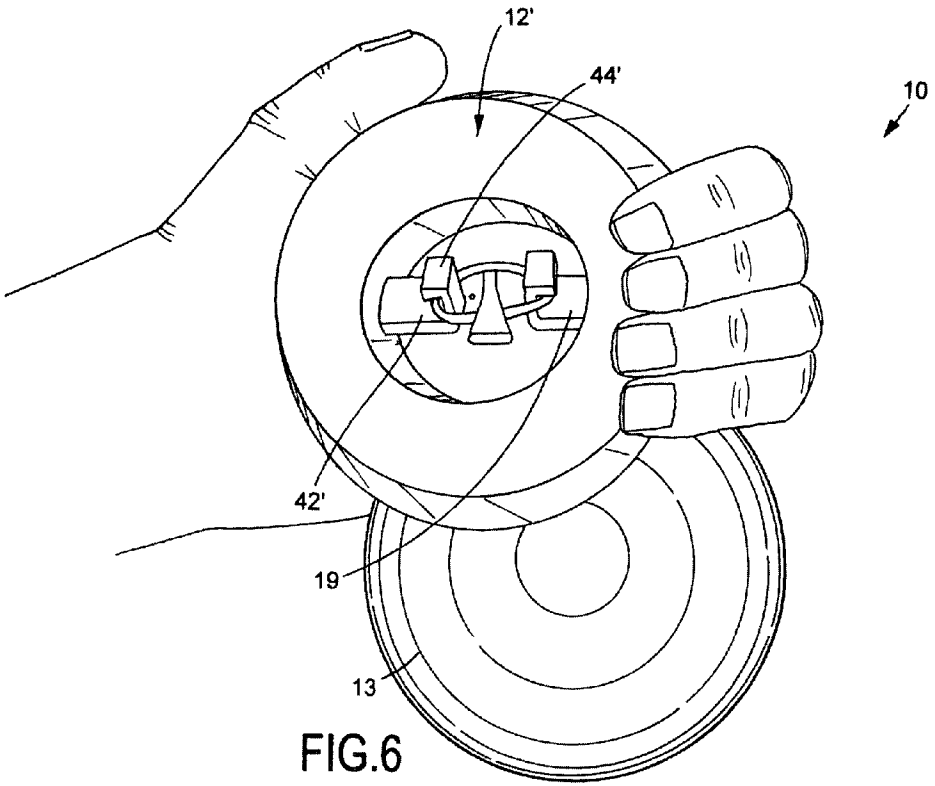
FIG. 6 is another perspective view illustrating the balloon-tying device of FIG. 5, constructed in accordance with the present invention, with the device being held by the user and the balloon in the process of being tied.

As illustrated in FIGS. 1-9, the present invention is a balloon-tying device, indicated generally at 10, for facilitating the tying of air-, water-, and helium-filled balloons 13. The balloon-tying device 10 of the present invention is a children's toy, a worker's tool, or a party favor to make balloon tying quicker and easier. The balloon-tying device 10 inhibits the problems of sore fingers and of children needing assistance in tying their balloons 13.

Preferably, the balloon-tying device 10 of the present invention is constructed of a sturdy and durable injection-molded thermoplastic material although constructing the balloon-tying device 10 from other material is within the scope of the present invention. The present invention can be produced in several alternative versions. In at least one embodiment, a pliable strap releasably secures the balloon-tying device 10 to a user's hand, as will be described in further detail below.

As best illustrated in FIGS. 1-4, in a first embodiment of the balloon-tying device 10 of the present invention, the balloon-tying device 10 includes base 12 having a top side surface 14, a bottom side surface 16 substantially opposite the top side surface 14, a first edge 18, a second edge 20 substantially opposite and parallel to the first edge 18, a third edge 22 between and substantially perpendicular to the first edge 18 and the second edge 20, and a fourth edge 24 substantially opposite and parallel to the third edge 22 and between and substantially perpendicular to the first edge 18 and the second edge 20. The base 12 is substantially rectangular with the first edge 18 and the second edge 20 having a length less than the third edge 22 and the fourth edge 24. The third edge 22 and the fourth edge 24 preferably have a length sufficient to cover the index finger and the middle finger of the user, as illustrated. It should be noted that while the base 12 has been described and illustrated as being rectangular, it is within the scope of the present invention for the base 12 to have other geometric shapes including, but not limited to, square, round, oval, etc.

In addition, the base of the balloon-tying device 10 includes a first slot 26 substantially parallel to and adjacent the first end 18 and a second slot 28 substantially parallel to and adjacent the second edge 20. A first strap portion 30 having a first end 32 and a second end 34 and a second strap portion 36 having a first end 38 and a second end 40 are also provided. The first end 32 of the first strap portion 30 is secured through the first slot 26 and the first end 38 of the second strap portion 36 is secured through the second slot 28. The second ends 34, 40 of the first strap portion 30 and the second strap portion 36, respectively, have different portions of a hook and loop fastener allowing a user to releasably secure the balloon-tying device 10 to his or her fingers, as illustrated and described further below.

The balloon-tying device 10 of the present invention further includes a pair of spaced tying prongs 42 each having a base end and a top end. The base ends of the tying prongs 42 are secured to the top surface 14 of the base 12 and extend in a generally upward direction. The top ends of the tying prongs 42 have a ridge 44 extending radially in a direction substantially parallel to the top surface 14 of the base 12. The ridges 44 assist in maintaining the balloon 13 on the balloon-tying device 10, as will be described in further detail below.

Each of the tying prongs 42 of the balloon-tying device 10 of the present invention further has a first side surface facing the first edge of the base, a second side surface substantially opposite the first side surface, a first end surface between the first side surface and the second side surface, and a second end surface substantially opposite the first end surface and between the first side surface and the second side surface. The lengths of the first side surface and the second side surface are preferably greater than the lengths of the first end surface and the second end surface. Furthermore, the first side surfaces and the second side surfaces are aligned substantially parallel to the first edge 18 and the second edge 20 of the base 12 and the first end surface and the second end surface are preferably angled inward allowing easy removal of the balloon 13 from the balloon-tying device 10.

In practice, the balloon-tying device 10 of the present invention is wrapped around the index and middle fingers of the user. After filling the balloon 13 with the desired medium, the filling end of the balloon 13 is wrapped around the tying prongs 42, as illustrated, with the ridges 44 maintaining the filling end of the balloon 13 on the tying prongs 42. Once the filling end of the balloon 13 has been tied, the user simply pulls the filling end in a general direction away from the base 12 and the filling end of the balloon 13 is gently urged over the ridges 44 and off the balloon-tying device 10. The balloon 13 is now tied and can be used in a desired manner.

In another embodiment of the balloon-tying device 10 of the present invention, as best illustrated in FIGS. 5-8, the balloon-tying device 10 has an annular base member 12' having a bottom or outer surface 16' and a top or inner surface 14'. In an embodiment, the bottom surface 16' preferably has a plurality of indentations 17 and resembles a tire while the top surface 14' is substantially smooth. A pair of tying prongs 42' extend from the top surface 14' in a general direction toward each other, substantially opposite each other. A ridge or hook 44' is formed on each end of the tying prongs 42' for maintaining the balloon 13 to the balloon-tying device 10 during tying operations.

Further referring to FIGS. 5-8, the balloon-tying device 10 of the present invention has a small spring-clamp 19. In practice, first, the balloon 13 is filled with air, water, or helium, and the spout (or filling end) of the balloon 13 is pinched shut by the fingers and fed through the hole in the underside of the balloon-tying device 10. The filled balloon 13 is now positioned at the edge of the balloon-tying device 10, and the filling end is stretched. The spring-loaded lever or button is pressed, extending the rod over the hole and pinching the balloon stem closed. The clamp 19 seals the balloon's filling end, prevents leakage, and holds the balloon stem in place. Now, by pulling the end of the balloon 13, the user employs the two tying prongs 42', fastened to the base 12' at one end and open at the other and uses the tying prongs 42' to facilitate the tying of the balloon 13, a quick and easy operation. The two tying prongs 42', in fact, function as additional "fingers" to make the knot-tying process quicker and more secure. Once the end of the balloon 13 is tied, the lever is released, and the balloon 13 can be slipped back out beneath the spring-clamp retainer 19 and is now ready for use. As the basic functional design of the balloon-tying device 10 of this embodiment works regardless of the basal or nozzle-adapting configuration, it can be seen that the balloon-tying device 10 can be produced in a wide variety of shapes, sizes, and patterns, i.e., not only in the shape and representation of an automobile tire, but of a clown, an animal, a round balloon: almost anything playful, festive, and fanciful.

Figure 7:
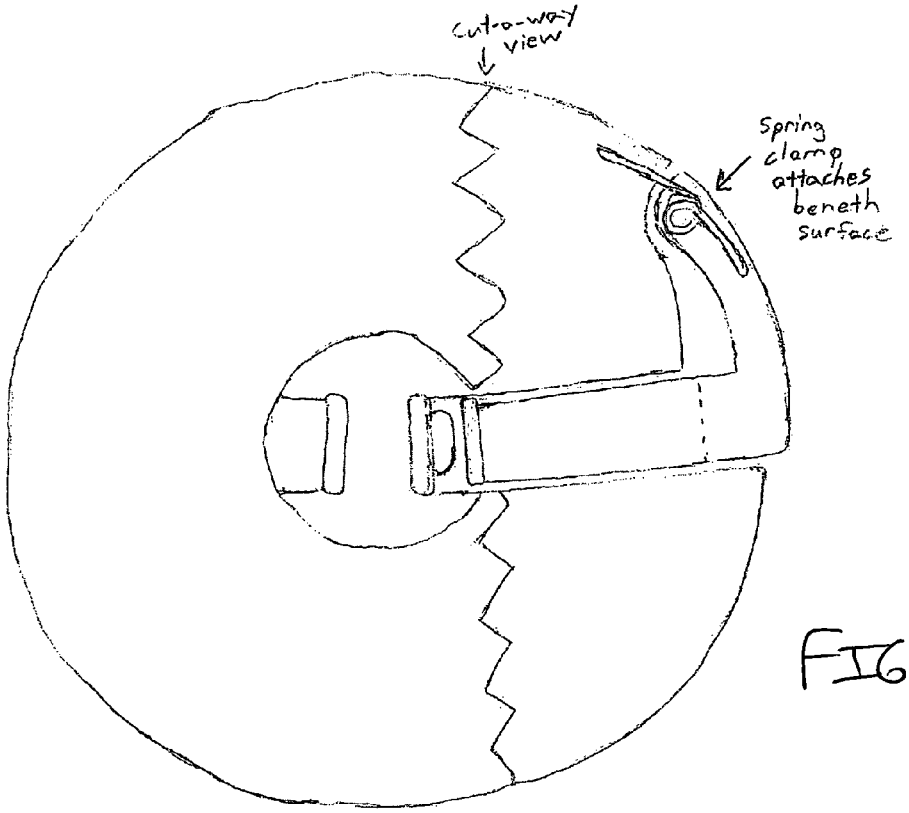
FIG. 7 is a top view illustrating the balloon-tying device of FIG. 5, constructed in accordance with the present invention, with the spring-loaded lever or button pinching the balloon stem closed.
Figure 8:
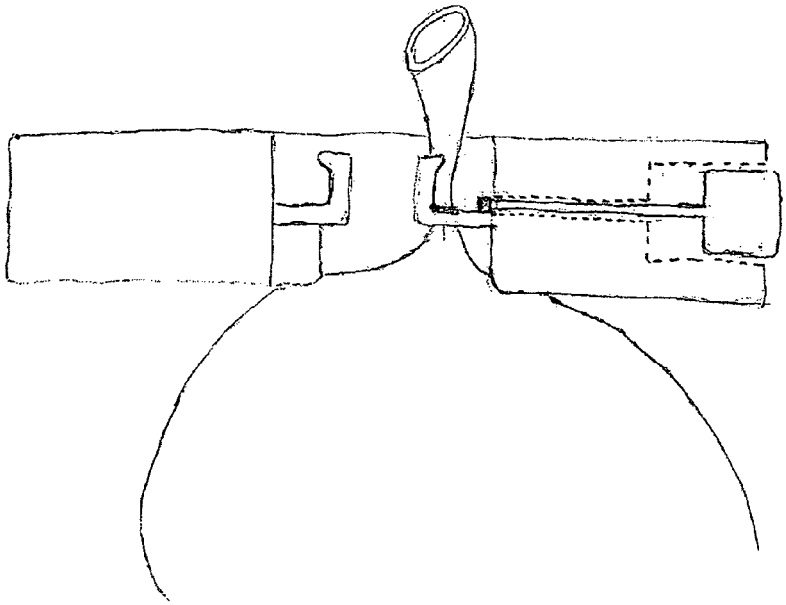
FIG. 8 is an elevational side view illustrating the balloon-tying device of FIG. 5, constructed in accordance with the present invention, with the spring-loaded lever or button pinching the balloon stem closed.
Figure 10:
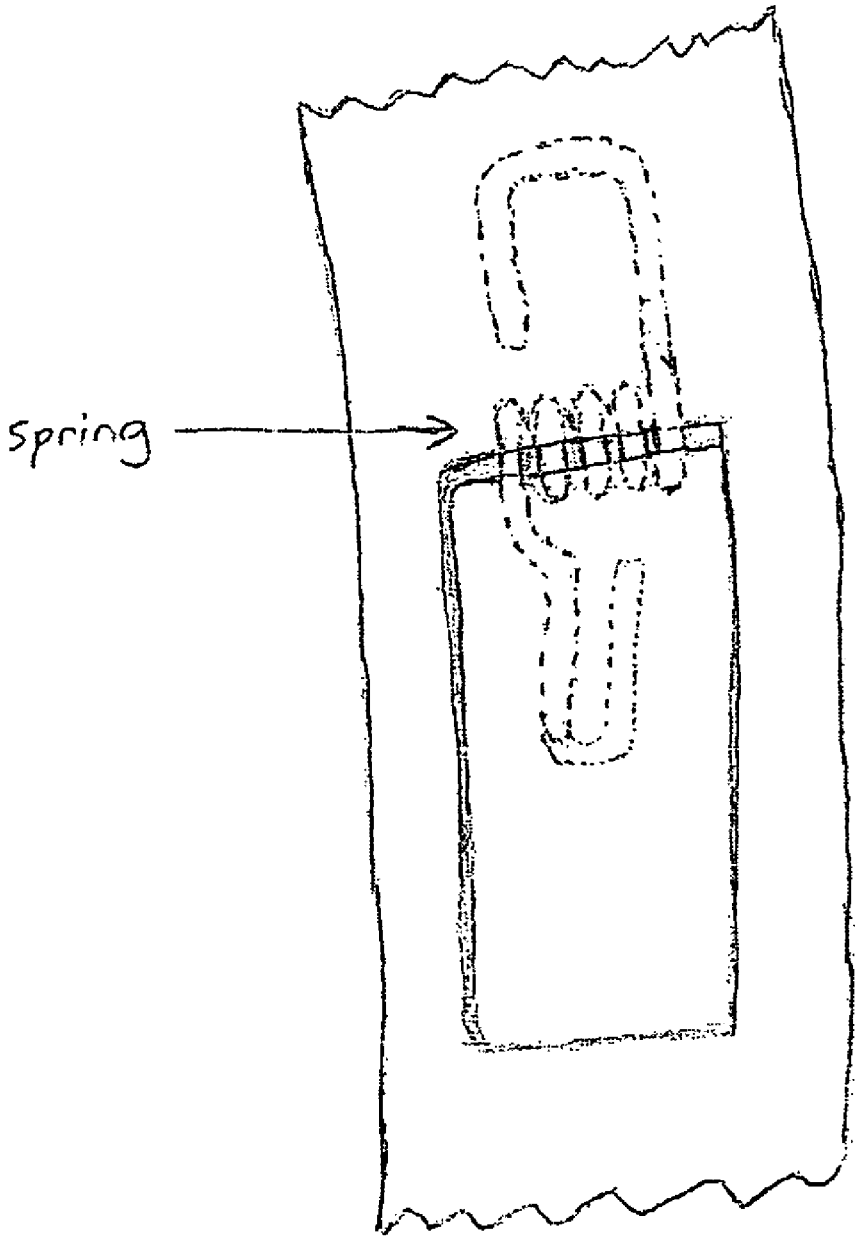
FIG. 10 is an end side view illustrating the balloon-tying device of FIG. 5, constructed in accordance with the present invention, with the spring-loaded lever or button pinching the balloon stem closed.
Figure 11:
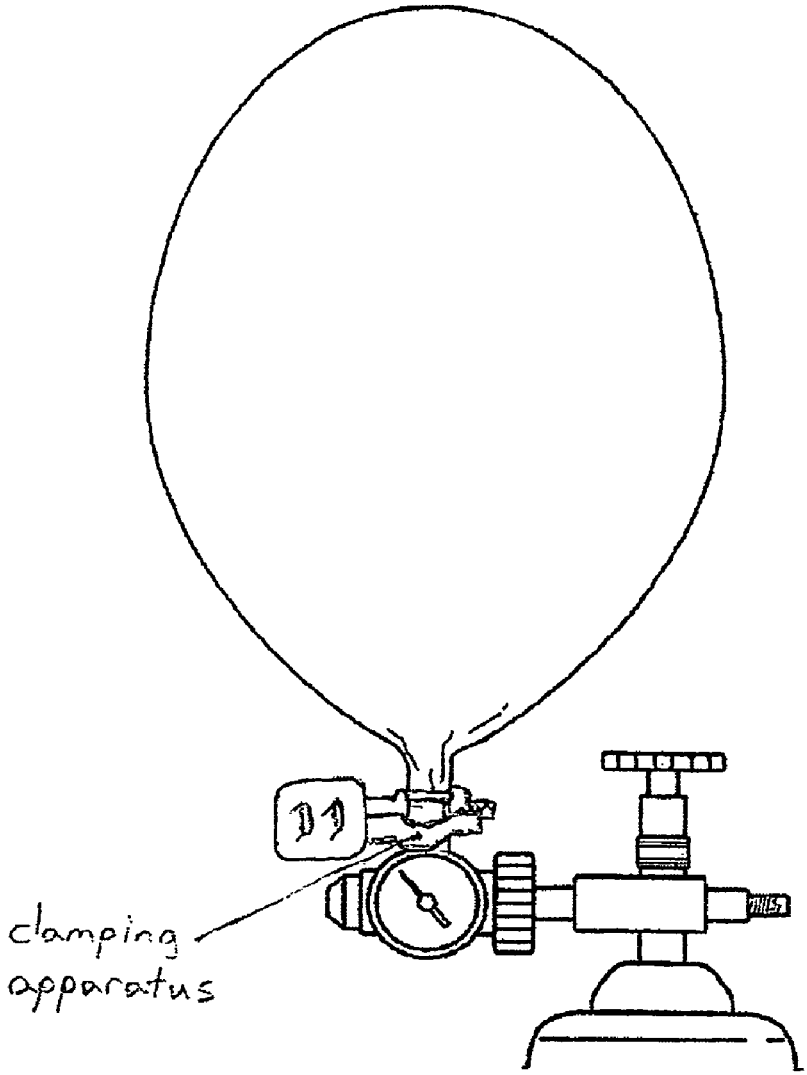
FIG. 11 is an elevational side view illustrating the threaded apparatus of the balloon-tying device, constructed in accordance with the present invention.
Figure 12:
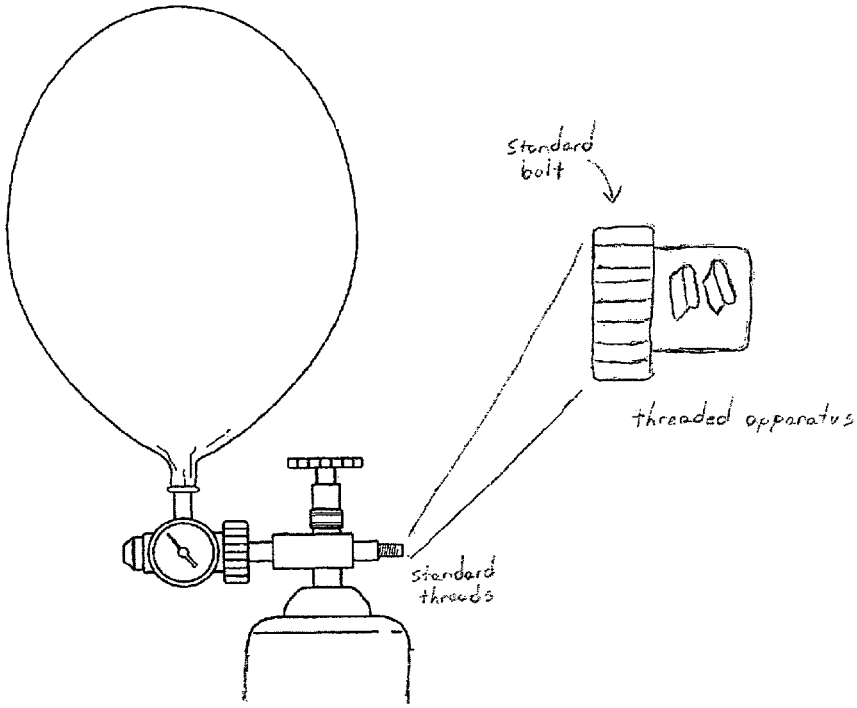
FIG. 12 is an elevational side view illustrating the clamping apparatus of the balloon-tying device, constructed in accordance with the present invention.

In still another embodiment of the balloon-tying device 10 of the present invention, as best illustrated in FIG. 7, the balloon-tying device 10 is built into the rear sight of a water gun or mounted at the nozzle of a helium tank via a threaded or clamping apparatus. In each case, the balloon-tying device 10 presents, a simple and easily used apparatus for securing the filled balloons and tying them.

The balloon-tying device 10 of the present invention presents a number of distinct and significant benefits and advantages. Foremost, the balloon-tying device 10 saves consumers, young and old, a tremendous amount of time and effort in the tying of balloons 13. For those users who need balloons 13 for a party, reception, or other festive occasion, the balloon-tying device 10 is a real time- and finger-saver, making short work of what would otherwise become an onerous, tedious chore. And, for those who provide uninflated balloons 13 for children's entertainment at parties and then wind up tying all the balloons for the kids, the balloon-tying device 10 not only relieves them of this task, but also gives the kids something fun to do. And for those whose vocation requires tying multiple balloons 13, i.e., caterers, event planners, and others, the balloon-tying device 10 actually reduces time and labor costs and makes the whole party-giving process run smoother and easier. Easy to use, compact, lightweight, portable, and durable, the balloon-tying device 10 can be employed variously as a child's toy, a party favor, or a worker's tool and will thus extend its notable benefits to children, adult consumers, and those in the party-giving business.

A device to facilitate the tying of air-, water-, or helium-filled balloons 13, the balloon-tying device 10 of the present invention enables the users or party-giver to quickly and easily tie any number of balloons 13 and to do so much more efficiently than is possible with conventional hand-tying methods.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A balloon-tying device for assisting in tying a balloon, the balloon having a filling end, the balloon-tying device comprising:

a base having a top surface and a bottom surface substantially opposite the top surface;

a pair of spaced tying prongs each having a base end and a top end, the base ends of the tying prongs secured to the top surface of the base;

a ridge extending from the top end of each of the tying prongs;

a first slot substantially parallel to and adjacent the first edge;

a second slot substantially parallel to and adjacent the second edge;

a first strap portion having a first end and a second end; and a second strap portion having a first end and a second end;

wherein the filling end of the balloon is wrappable around the tying prongs and fed between the tying prongs;

wherein the ridges maintain the filling end of the balloon from inadvertently slipping from the tying prongs during the tying process;

wherein the base has a first edge, a second edge substantially opposite and parallel to the first edge, a third edge between and substantially perpendicular to the first edge and the second edge, and a fourth edge substantially opposite and parallel to the third edge and between and substantially perpendicular to the first edge and the second edge, the base being substantially rectangular with the first edge and the second edge having a length less than the third edge and the fourth edge;

wherein the first end of the first strap portion is securable through the first slot; and wherein the first end of the second strap is securable through the second slot.

2. The balloon-tying device of claim 1 wherein the second ends of the first strap and the second strap have different portions of a hook and loop fastener allowing a user to releasably secure the balloon-tying device to his or her fingers.

3. The balloon-tying device of claim 1 wherein the tying prongs extend in a generally upward direction away from the top surface of the base.

4. The balloon-tying device of claim 1 wherein the ridge extends annularly around the tying prongs in a direction substantially parallel to the top surface of the base.

5. The balloon-tying device of claim 1 wherein each of the tying prongs has a first side surface facing the first edge of the base, a second side surface substantially opposite the first side surface, a first end surface between the first side surface and the second side surface, and a second end surface substantially opposite the first end surface and between the first side surface and the second side surface, the lengths of the first side surface and the second side surface are greater than the lengths of the first end surface and the second end surface, the first end surface and the second end surface angled inward.

6. The balloon-tying device of claim 1 wherein the base is substantially annular, the bottom surface having a plurality of indentations and the top surface being smooth.

7. The balloon-tying device of claim 6 wherein the tying prongs extend from the top surface in a general direction toward each other, substantially opposite each other.

8. The balloon-tying device of claim 6 and further comprising:

a spring-clamp for pinching the filling end of the balloon shut.

9. The balloon-tying device of claim 1 wherein the balloon-tying device is mountable on a water gun or at the nozzle of a helium tank, and further comprising:

a threaded or clamping apparatus for attachment to the water gun or nozzle.

10. A method for assisting in tying a balloon, the balloon having a filling end, the method comprising:

providing a base having a top surface and a bottom surface substantially opposite the top surface;

securing a pair of spaced tying prongs to the top surface of the base;

extending a ridge from an unsecured end of each of the tying prongs;

wrapping the filling end of the balloon around the tying prongs;

feeding the filling end between the tying prongs; and maintaining the filling end of the balloon from inadvertently slipping from the tying prongs during the tying process.

11. A balloon-tying device for assisting in tying a balloon, the balloon having a filling end, the balloon-tying device comprising:

a base having a top surface and a bottom surface substantially opposite the top surface;

a pair of spaced tying prongs each having a base end and a top end, the base ends of the tying prongs secured to the top surface of the base; and a ridge extending from the top end of each of the tying prongs;

a first slot substantially parallel to and adjacent the first end;

a second slot substantially parallel to and adjacent the second edge;

a first strap portion having a first end and a second end; and a second strap portion having a first end and a second end;

wherein the first end of the first strap portion is securable through the first slot;

wherein the first end of the second strap is securable through the second slot;

wherein the filling end of the balloon is wrappable around the tying prongs and fed between the tying prongs; and wherein the ridges maintain the filling end of the balloon from inadvertently slipping from the tying prongs during the tying process.

12. The balloon-tying device of claim 11 wherein the second ends of the first strap and the second strap have different portions of a hook and loop fastener allowing a user to releasably secure the balloon-tying device to their fingers.

13. The balloon-tying device of claim 11 wherein the ridge extends radially around the tying prongs in a direction substantially parallel to the top surface of the base.

14. The balloon-tying device of claim 11 wherein each of the tying prongs has a first side surface facing the first edge of the base, a second side surface substantially opposite the first side surface, a first end surface between the first side surface and the second side surface, and a second end surface substantially opposite the first end surface and between the first side surface and the second side surface, the lengths of the first side surface and the second side surface are greater than the lengths of the first end surface and the second end surface, the first end surface and the second end surface angled inward.

15. The balloon-tying device of claim 11 wherein the base has a first edge, a second edge substantially opposite and parallel to the first edge, a third edge between and substantially perpendicular to the first edge and the second edge, and a fourth edge substantially opposite and parallel to the third edge and between and substantially perpendicular to the first edge and the second edge, the base being substantially rectangular with the first edge and the second edge having a length less than the third edge and the fourth edge, and wherein the tying prongs extend in a generally upward direction away from the top surface of the base.

16. A balloon-tying device for assisting in tying a balloon, the balloon having a filling end, the balloon-tying device comprising:

a base having a top surface and a bottom surface substantially opposite the top surface, the base being substantially annular, the bottom surface having a plurality of indentations and the top surface being smooth;

a pair of spaced tying prongs each having a base end and a top end, the base ends of the tying prongs secured to the top surface of the base; and a ridge extending from the top end of each of the tying prongs;

wherein the filling end of the balloon is wrappable around the tying prongs and fed between the tying prongs; and wherein the ridges maintain the filling end of the balloon from inadvertently slipping from the tying prongs during the tying process.

17. The balloon-tying device of claim 16 wherein the tying prongs extend from the top surface in a general direction toward each other, substantially opposite each other.

18. The balloon-tying device of claim 16 and further comprising:

a spring-clamp for pinching the filling end of the balloon shut.

* * * * *